US010034107B2

(12) United States Patent
Nielsen et al.

(10) Patent No.: US 10,034,107 B2
(45) **Date of Patent: *Jul. 24, 2018**

(54) HEARING AID

(71) Applicant: GN Hearing A/S, Ballerup (DK)

(72) Inventors: Henrik Nielsen, Roskilde (DK); Vince Maye, Brampton (CA); Goran Hall, Minneapolis, MN (US); Kevin Mikes, Grayslake, IL (US); Brian Tsuchiya, Eden Prairie, MN (US)

(73) Assignee: GN Hearing A/S, Ballerup (DK)

( * ) Notice: Subject to any disclaimer, the term of this patent is extended or adjusted under 35 U.S.C. 154(b) by 726 days.

This patent is subject to a terminal disclaimer.

(21) Appl. No.: 13/764,751

(22) Filed: Feb. 11, 2013

(65) Prior Publication Data

US 2013/0216079 A1 Aug. 22, 2013

Related U.S. Application Data

(63) Continuation of application No. 12/186,370, filed on Aug. 5, 2008, now Pat. No. 8,374,367, which is a (Continued)

(30) Foreign Application Priority Data

Jun. 23, 2006 (DK) ..... 2006 00853

(51) Int. Cl.
*H04R 25/00* (2006.01)

(52) U.S. Cl.
CPC ..... *H04R 25/658* (2013.01); *H04R 25/652* (2013.01); *H04R 25/405* (2013.01); *H04R 25/656* (2013.01); *H04R 2225/63* (2013.01)

(58) Field of Classification Search
USPC ..... 381/328, 322
See application file for complete search history.

(56) References Cited

U.S. PATENT DOCUMENTS 3,783,201 A * 1/1974 Weiss et al. ..... 381/324
4,553,627 A 11/1985 Gastmeier et al.
(Continued)

FOREIGN PATENT DOCUMENTS

CH 673551 A5 2/1984
CN 1124003 A 6/1996
(Continued)

OTHER PUBLICATIONS

Japanese Office Action dated Oct. 1, 2013 for related JP Patent Application No. 2009-515706, 3 pages.
(Continued)

*Primary Examiner* — Amir Etesam
(74) *Attorney, Agent, or Firm* — Vista IP Law Group, LLP

(57) ABSTRACT

A hearing aid includes a shell for accommodation of a signal processor for processing an audio signal into a processed audio signal, and a receiver that is connected to an output of the signal processor for converting the processed audio signal into an acoustic sound signal, and a flexible elongated member with a first end attached to the shell, and a second free end, wherein the flexible elongated member comprises a lumen for housing a wire that is for providing current to an electronic device, the flexible elongated member having a shape for stabilizing the shell relative to a user's ear.

34 Claims, 10 Drawing Sheets

Figure 1:
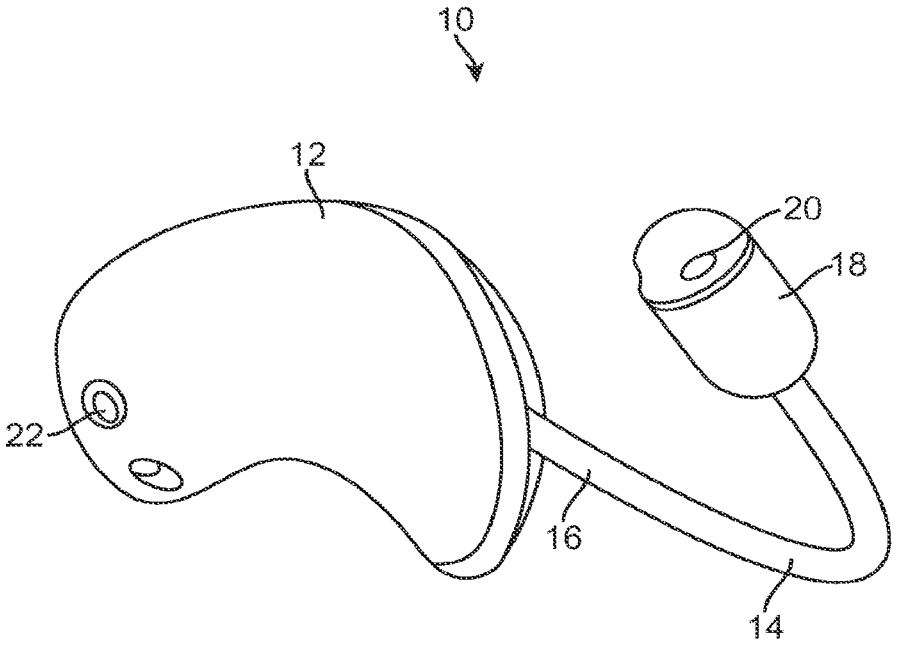

Related U.S. Application Data continuation-in-part of application No. 12/278,241, filed as application No. PCT/DK2007/000305 on Jun. 22, 2007, now Pat. No. 8,331,593.

(60) Provisional application No. 60/816,246, filed on Jun. 23, 2006.

(56) References Cited

U.S. PATENT DOCUMENTS

| | | | | |
|---|---|---|---|---|
| 4,791,672 | A * | 12/1988 | Nunley et al. | 381/317 |
| 5,048,090 | A * | 9/1991 | Geers | 381/328 |
| 5,201,006 | A | 4/1993 | Weinrich | |
| 5,403,262 | A | 4/1995 | Gooch | |
| 5,619,580 | A | 4/1997 | Hansen | |
| 5,654,530 | A | 8/1997 | Sauer et al. | |
| 5,680,467 | A | 10/1997 | Hansen | |
| 5,784,470 | A | 7/1998 | Fackler et al. | |
| 5,889,874 | A | 3/1999 | Schmitt et al. | |
| 6,493,454 | B1 * | 12/2002 | Loi et al. | 381/328 |
| 6,498,858 | B2 | 12/2002 | Kates | |
| 6,532,294 | B1 * | 3/2003 | Rudell | 381/315 |
| 6,704,423 | B2 * | 3/2004 | Anderson et al. | 381/313 |
| 6,940,989 | B1 | 9/2005 | Shennib et al. | |
| 7,130,437 | B2 | 10/2006 | Stonikas et al. | |
| 7,424,124 | B2 | 9/2008 | Shennib et al. | |
| 7,899,200 | B2 | 3/2011 | Karamuk et al. | |
| 2001/0043707 | A1 | 11/2001 | Leedom | |
| 2001/0051776 | A1 | 12/2001 | Lenhardt | |
| 2004/0047483 | A1 | 3/2004 | Bauman | |
| 2004/0096075 | A1 * | 5/2004 | Kuhlmann | A61F 11/00 381/312 |
| 2004/0131200 | A1 | 7/2004 | Davis | |
| 2004/0258264 | A1 * | 12/2004 | Jorgensen et al. | 381/328 |
| 2005/0078843 | A1 | 4/2005 | Bauman | |
| 2005/0190940 | A1 | 9/2005 | Ach-Kowalewski et al. | |
| 2006/0050914 | A1 | 3/2006 | Urso et al. | |
| 2006/0147072 | A1 | 7/2006 | Sodoma et al. | |
| 2006/0239483 | A1 | 10/2006 | Orts et al. | |
| 2007/0036374 | A1 | 2/2007 | Bauman | |

FOREIGN PATENT DOCUMENTS

| | | | |
|---|---|---|---|
| DE | 8328154 | U1 | 2/1984 |
| DE | 29801567 | U1 | 4/1998 |
| DE | 19706306 | C1 | 10/1998 |
| DE | 29718483 | U1 | 2/1999 |
| DE | 29718503 | U1 | 4/1999 |
| DE | 29916891 | U1 | 3/2000 |
| EP | 0368125 | A2 | 5/1990 |
| EP | 1448014 | A1 | 8/2004 |
| EP | 1 599 069 | A1 | 11/2005 |
| EP | 1594340 | A | 11/2005 |
| EP | 1653776 | | 5/2006 |
| GB | 2134689 | A | 8/1984 |
| JP | 5-199590 | A | 8/1993 |
| JP | 10-512116 | A | 11/1998 |
| JP | 2000-506697 | A | 5/2000 |
| JP | 2001-512943 | A | 8/2001 |
| JP | 2003-511940 | A | 3/2003 |
| JP | 2004-229181 | A | 8/2004 |
| WO | WO 9621334 | A1 | 7/1996 |
| WO | WO 9734443 | A1 | 9/1997 |
| WO | WO 199851125 | A | 11/1998 |
| WO | WO 99/07182 | A2 | 2/1999 |
| WO | 00/32009 | | 6/2000 |
| WO | WO 200076271 | A | 12/2000 |
| WO | WO 200108443 | A2 | 2/2001 |
| WO | WO 0128289 | A1 | 4/2001 |
| WO | WO 2002003757 | A1 | 1/2002 |
| WO | WO 2002052890 | A1 | 7/2002 |
| WO | WO 2004010734 | A1 | 1/2004 |
| WO | WO 2004036953 | | 4/2004 |
| WO | WO 2007147415 | A1 | 12/2007 |

OTHER PUBLICATIONS

European Office Action dated Nov. 6, 2013 for related EP Patent Application No. 07 722 682.7, 5 pages.
Office Action dated Mar. 15, 2010 for EP Application No. 07722683.5.
Written Opinion of the International Search Authority for PCT/DK2007/000305.
International Preliminary Report on Patentability and Written Opinion of the International Search Authority for PCT/DK2007/000307.
International Preliminary Report on Patentability and Written Opinion of the International Search Authority for PCT/DK2007/000306.
Office Action dated Jan. 11, 2012 for CN Application No. 200780030352.X.
Pawel J. Jastreboff, "Tinnitus Habituation Therapy (THT) and Tinnitus Retraining Therapy (TRT)", In Tyler RS, ed. Handbook of Tinnitus. San Diego: Singular Publishing; 2000:357-375.
Luca Del Bo et al, "Using Open-Ear Hearing Aids in Tinnitus Theraphy", Hearing Review, Aug. 2006.
Non-Final Office Action dated Oct. 17, 2011, for U.S. Appl. No. 12/299,047.
Final Office Action dated Apr. 19, 2012, for U.S. Appl. No. 12/299,047.
Non-Final Office Action dated Aug. 18, 2011, for U.S. Appl. No. 12/278,241.
Final Office Action dated Feb. 16, 2012, for U.S. Appl. No. 12/278,241.
Advisory Action dated Apr. 25, 2012, for U.S. Appl. No. 12/278,241.
Non-Final Office Action dated Aug. 16, 2011, for U.S. Appl. No. 12/186,370.
Final Office Action dated Jan. 18, 2012, for U.S. Appl. No. 12/186,370.
Non-Final Office Action dated Oct. 26, 2011, for U.S. Appl. No. 12/299,101.
Final Office Action dated Jun. 21, 2012, for U.S. Appl. No. 12/299,101.
Notice of Allowance and Fee(s) Due dated Jul. 20, 2012, for U.S. Appl. No. 12/278,241.
Notice of Allowance and Fee(s) Due dated Aug. 17, 2012, for U.S. Appl. No. 12/278,241.
Notice of Allowance and Fee(s) Due dated Aug. 21, 2012, for U.S. Appl. No. 12/186,370.
Office Action dated Jul. 10, 2012 for JP Patent Application No. 2009-515705.
English Translation of the Office Action dated Jul. 10, 2012 for JP Patent Application No. 2009-515705.
Office Action dated Jul. 10, 2012 for JP Patent Application No. 2009-515706.
English Translation of the Office Action dated Jul. 10, 2012 for JP Patent Application No. 2009-515706.
Office Action dated Jul. 10, 2012 for JP Patent Application No. 2009-515707.
English Translation of the Office Action dated Jul. 10, 2012 for JP Patent Application No. 2009-515707.
Machine English Translation of JP 05199590 dated Aug. 6, 1993.
Advisory Action dated Sep. 4, 2012, for U.S. Appl. No. 12/299,047.
Final Office Action dated Sep. 5, 2012, for U.S. Appl. No. 12/299,101.
Notice of Allowance and Fees Due dated Oct. 4, 2012, for U.S. Appl. No. 12/186,370.
Corrected Notice of Allowability dated Oct. 2, 2012, for U.S. Appl. No. 12/278,241.
Corrected Notice of Allowability dated Oct. 31, 2012, for U.S. Appl. No. 12/278,241.
Corrected Notice of Allowability dated Nov. 6, 2012, for U.S. Appl. No. 12/186,370.
Advisory Action dated Nov. 26, 2012, for U.S. Appl. No. 12/299,101.
Final Office Action dated Feb. 5, 2013, for JP Patent Application No. 2009-515705.
Non-final Office Action dated Mar. 29, 2013 for U.S. Appl. No. 12/299,101.

(56) References Cited

OTHER PUBLICATIONS

Notice of Allowance and Fees Due dated Sep. 12, 2013 for U.S. Appl. No. 12/299,047.
Final Office Action dated Jan. 14, 2014, for U.S. Appl. No. 12/299,101.
Notice of Allowance and Fee(s) Due dated Sep. 30, 2014 for U.S. Appl. No. 12/299,101.
Japanese Office Action dated May 27, 2014 for related JP Patent Application No. 2013-123793, 7 pages.
Notice of Reason for Refusal dated Mar. 3, 2015, for related Japanese Patent Application No. 2013-123793, 8 pages.

* cited by examiner

HEARING AID

RELATED APPLICATION DATA

This application is a continuation of U.S. patent application Ser. No. 12/186,370, filed on Aug. 5, 2008, pending, which is a continuation-in-part of U.S. patent application Ser. No. 12/278,241, filed on Aug. 4, 2008, now U.S. Pat. No. 8,331,593, which is the national stage of International Application No. PCT/DK2007/000305, filed on Jun. 22, 2007, which claims the benefit of U.S. Provisional Patent Application No. 60/816,246, filed on Jun. 23, 2006, and Danish Patent Application No. PA 2006 00853, filed on Jun. 23, 2006, the entire disclosures of all of the above applications are expressly incorporated by reference herein.

FIELD

The present application relates to a new type of hearing aid with a custom made shell that is individually shaped to fit an ear canal of a specific user for accommodation in the ear canal and wherein a flexible elongated member is attached to the shell, the flexible elongated member being configured for positioning in the pinna outside the ear canal of the user.

BACKGROUND

A conventional in the ear (ITE) or completely-in-the-canal (CIC) hearing aid has a shell that is individually custom manufactured to fit precisely in the ear canal of the user so that the shell can be retained securely in its intended position in the ear canal. The shell contains the hearing aid components, e.g. electronics, microphone, receiver, battery, etc. Typically, the customized shell is made from solid materials to secure retention of the shell in the ear canal and tightness of the fit.

SUMMARY

According to some embodiments, a hearing aid is provided with a custom made shell that is individually shaped to fit an ear canal of a specific user.

In accordance with other embodiments, a flexible elongated member is attached to the shell. The flexible elongated member has a first end that is attached to the shell and an opposite second free end. The flexible elongated member is configured so that the second free end is positioned inside the pinna and outside the ear canal of the user.

In accordance with other embodiments, a hearing aid includes a shell for accommodation of a signal processor for processing an audio signal into a processed audio signal, and a receiver that is connected to an output of the signal processor for converting the processed audio signal into an acoustic sound signal, and a flexible elongated member with a first end attached to the shell, and a second free end, wherein the flexible elongated member comprises a lumen for housing a wire that is for providing current to an electronic device, the flexible elongated member having a shape for stabilizing the shell relative to a user's ear.

In accordance with other embodiments, a hearing aid includes a shell for accommodation of a signal processor for processing an audio signal into a processed audio signal and a receiver that is connected to an output of the signal processor for converting the processed audio signal into an acoustic sound signal, and a flexible elongated member with a first end attached to the shell, and a second free end, wherein the flexible elongated member comprises a lumen for housing a wire that is for providing current to an electronic device, the flexible elongated member having a shape for stabilizing the shell relative to a user's ear.

DESCRIPTION OF DRAWING FIGURES

Figure 2:
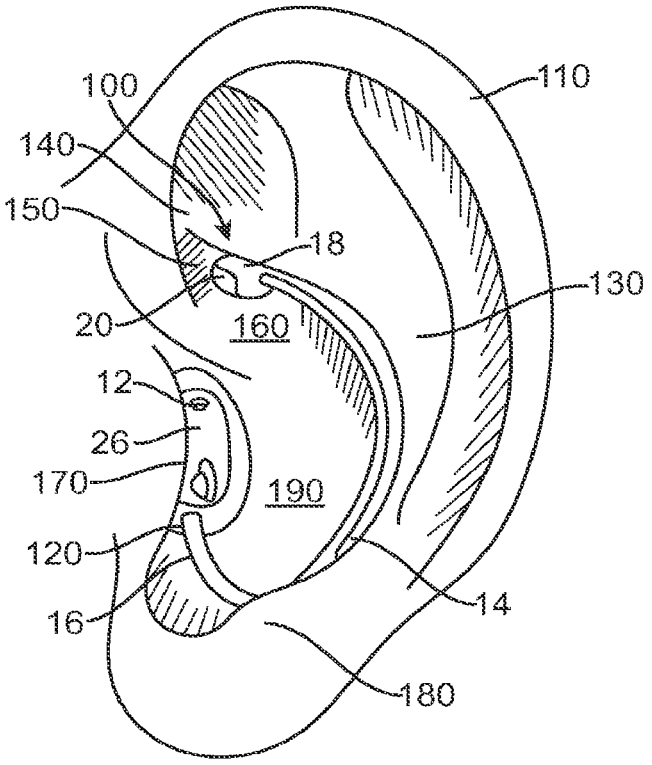
Figure 3A:
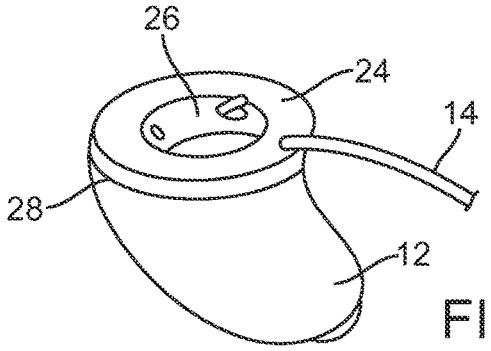
Figure 3B:
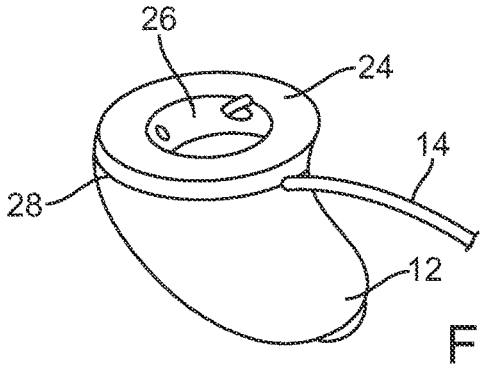
Figure 3C:
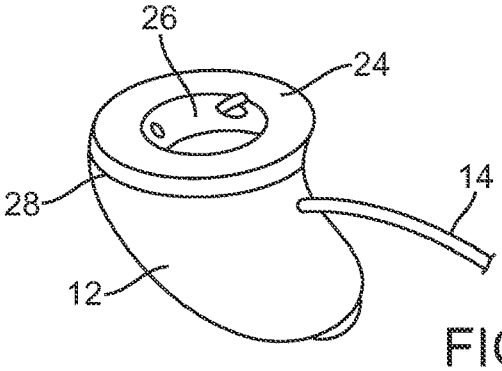
Figure 3D:
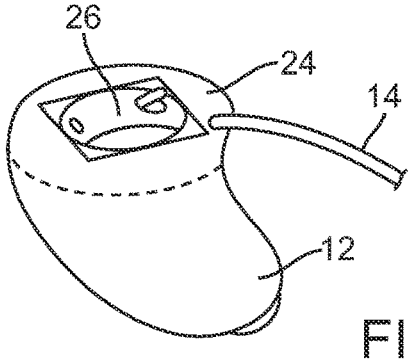
Figure 4A:
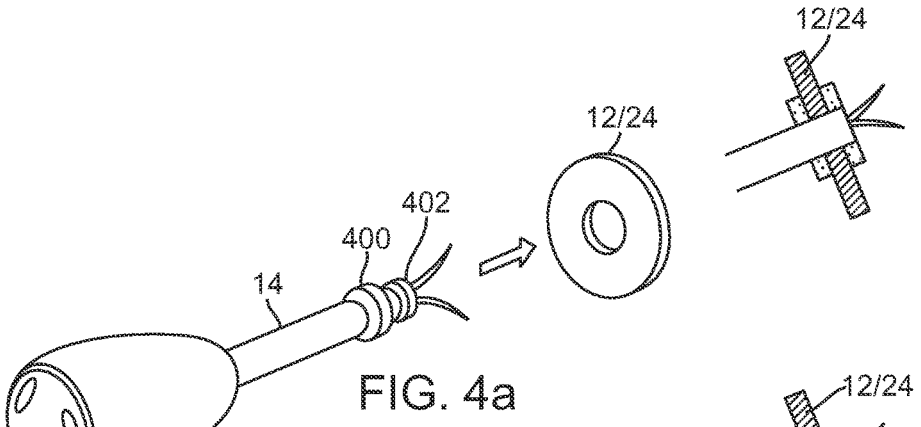
Figure 4B:
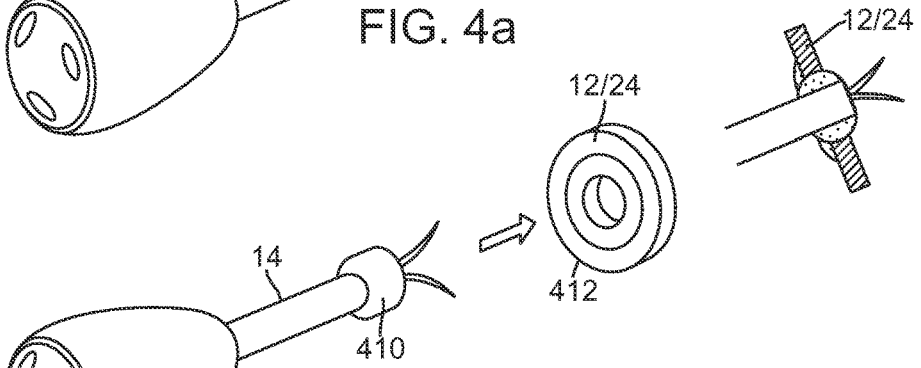
Figure 4C:
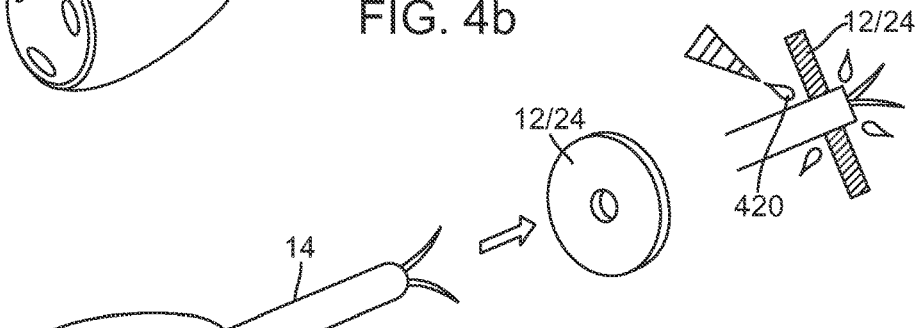
Figure 4D:
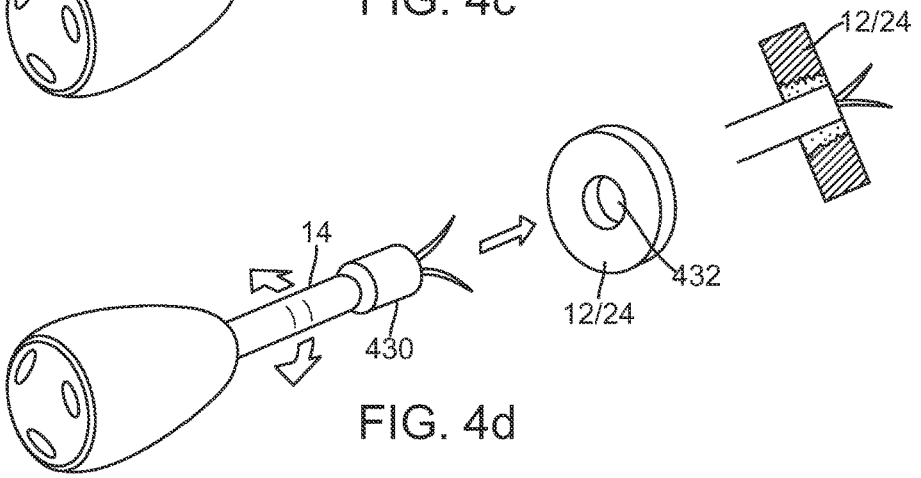
Figure 5:
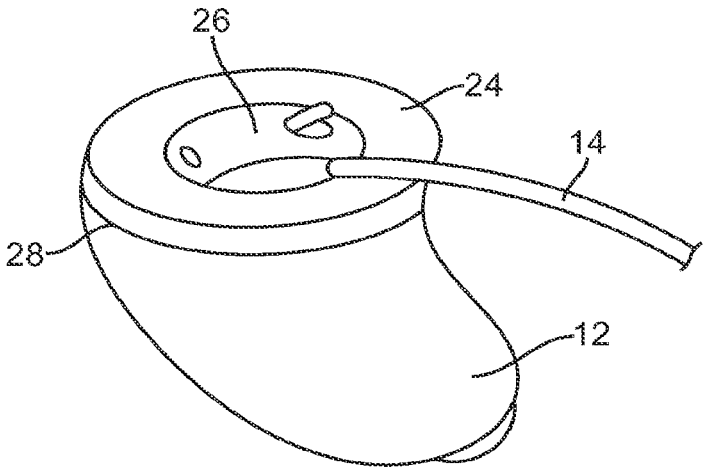
Figure 6A:
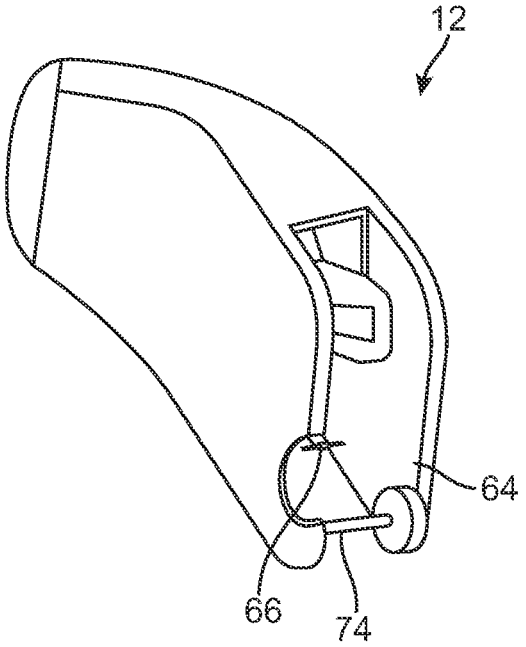
Figure 6B:
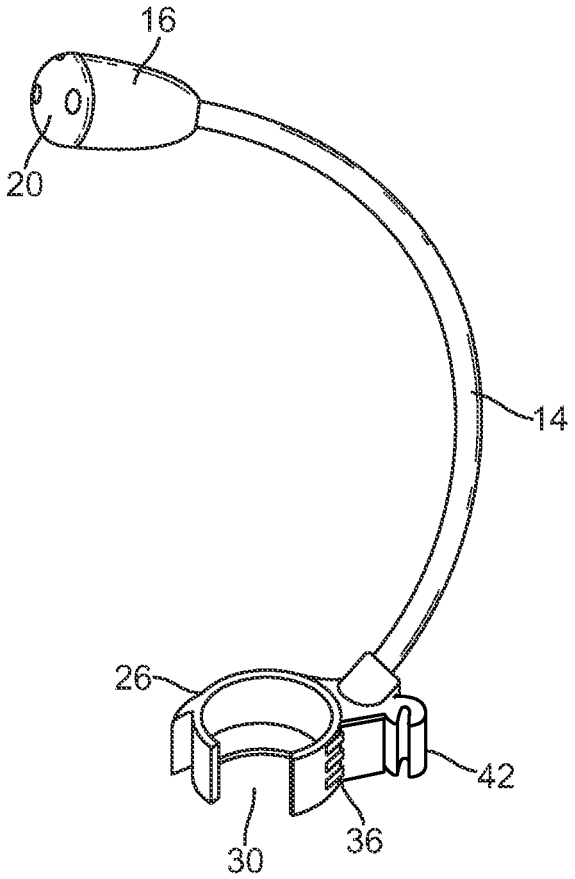
Figure 7A:
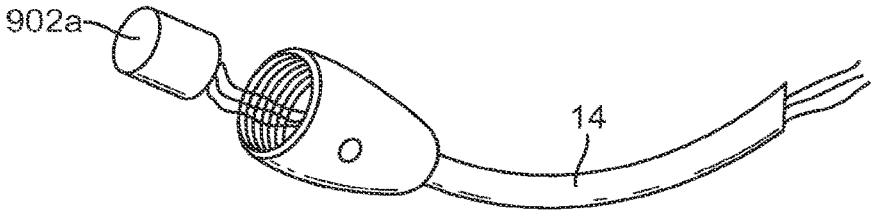
Figure 7B:
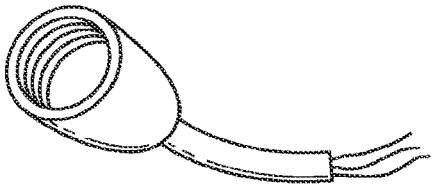
Figure 7C:
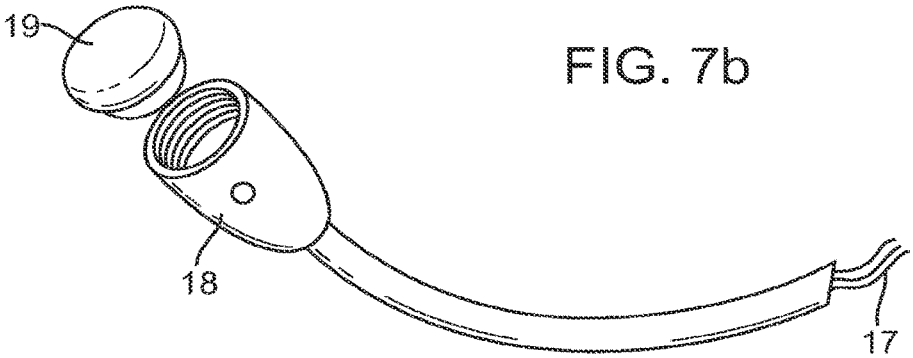
Figure 8:
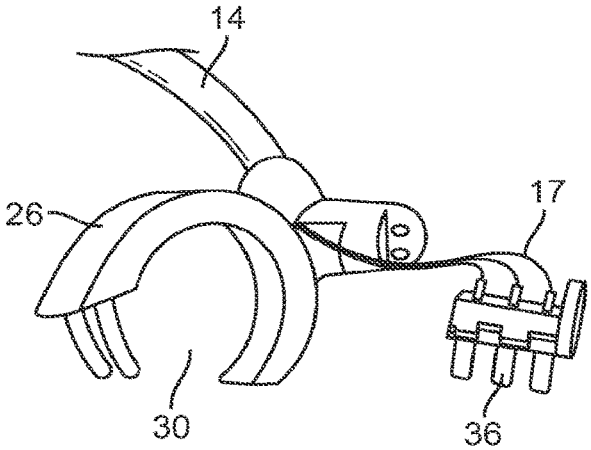
Figure 9:
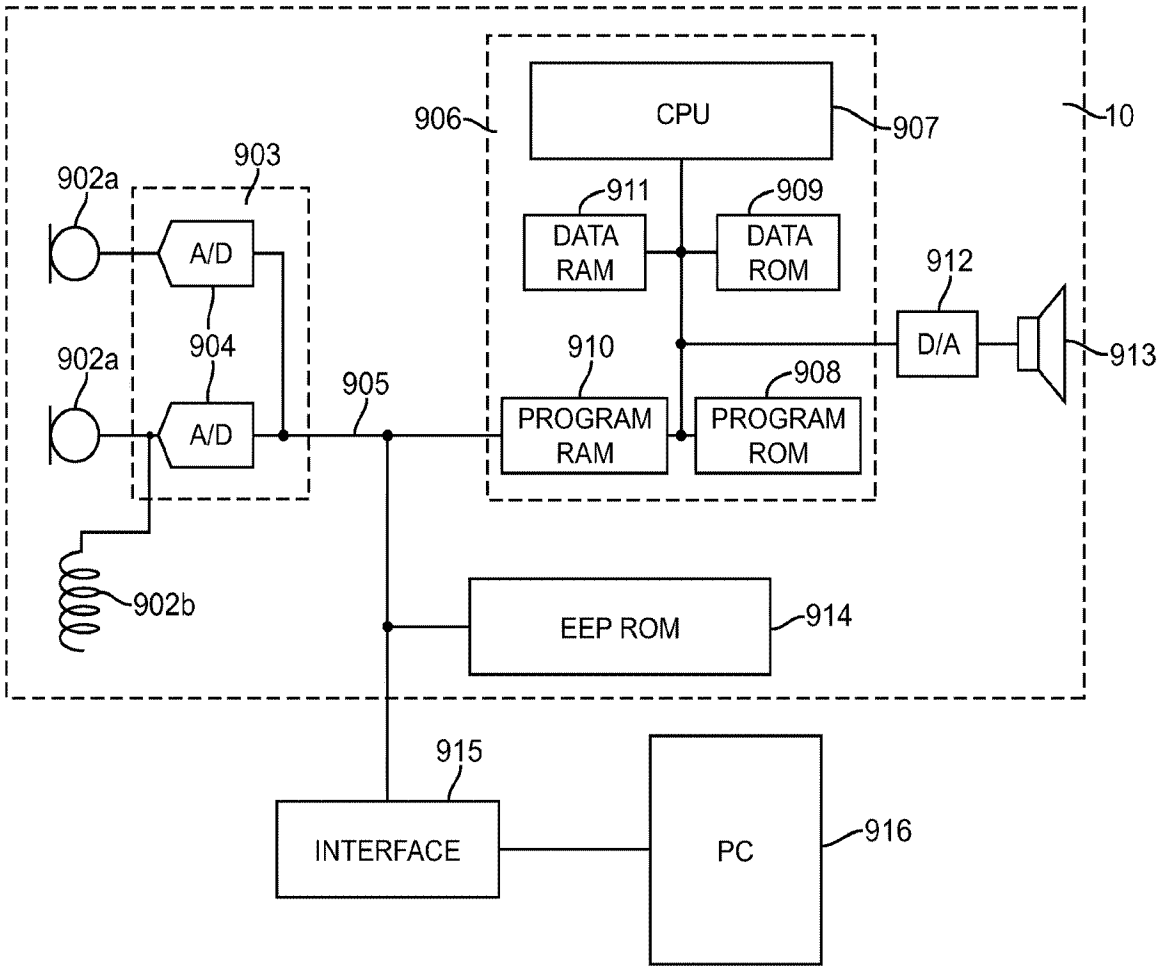
Figure 10:
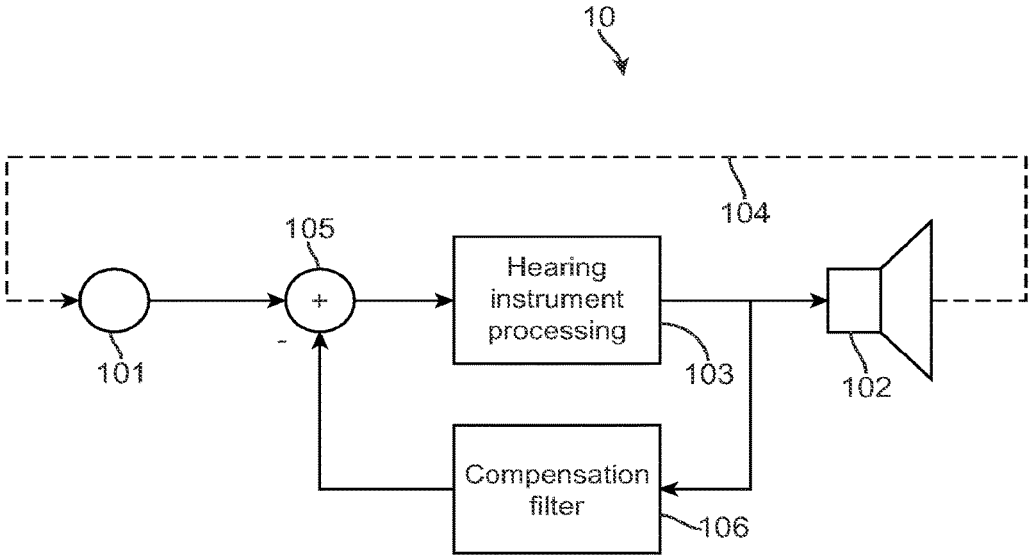

Various embodiments of the hearing aid will be described in more detail with reference to the drawings, wherein FIG. 1 is a perspective view of a hearing aid in accordance with some embodiments, FIG. 2 shows the hearing aid of FIG. 1 positioned in the ear of a user, FIGS. 3*a*-3*d* show various embodiments of a battery door, FIGS. 4*a*-4*d* show various embodiments of different interconnections of an elongated member to a shell or faceplate, FIG. 5 shows an embodiment of a battery door and a connector, FIGS. 6*a*-6*b* show a shell and a flexible elongated member connected to a battery door in accordance with some embodiments, FIGS. 7*a*-7*c* illustrate positioning of a microphone at an end of a flexible elongated member, FIG. 8 shows details of an interconnection between a flexible elongated member and a battery door, FIG. 9 shows a simplified block diagram of a digital hearing aid enclosed in a shell according to some embodiments, FIG. 10 shows a block diagram of a hearing aid with one feedback compensation filter, and FIGS. 11*a*-11*f* show different views of a hearing aid having exemplary dimensions in accordance with some embodiments.

DETAILED DESCRIPTION

The various embodiments of a hearing aid will now be described more fully hereinafter with reference to the accompanying drawings, in which exemplary embodiments are shown. The figures are schematic and simplified for clarity, and they merely show details which are essential to the understanding of the embodiments, while other details have been left out. Throughout, the same reference numerals are used for identical or corresponding parts.

In addition to the illustrated embodiments, the invention may be embodied in different forms and should not be construed as limited to the embodiments set forth herein.

FIG. 1 shows in perspective view a hearing aid 10 according to some embodiments. FIG. 2 shows the hearing aid 10 of FIG. 1 positioned in the ear of a user with indications of major anatomical features of the pinna. The illustrated hearing aid 10 has a custom made shell 12 for accommodation of hearing aid components and configured to be positioned in the ear canal 120 of a user comfortably fitting the ear canal 120 for retention of the shell 12 in the ear of the user. As used in this specification, the term "shell" refers to any structure, such as a housing, that partially or completely surrounds one or more components, wherein the structure may be formed as a single piece, or may be formed from a plurality of parts. The hearing aid 10 comprises a microphone for converting sound into an audio signal. The microphone may or may not be accommodated in the custom made shell 12. The custom made shell 12 accommodates a signal processor for processing the audio signal into an audio signal compensating a hearing loss, and a speaker (e.g., a loud speaker) that is connected to an output of the signal processor for converting the processed compensated audio signal into an acoustic sound signal for emission through an output port 22 of the shell 12 towards the eardrum of the user. Further, the custom made shell 12 accommodates a battery for power supply of the electric components of the hearing aid 10.

In accordance with hearing aid terminology, the speaker is also denoted a receiver throughout the present specification.

The shell 12 is connected to a flexible elongated member 14 with a first end 16 attached to the shell 12 and an opposite second free end 18 and wherein the flexible elongated member 14 is configured for positioning in the pinna 100 and outside the ear canal 120 of the user.

The flexible elongated member 14 may be resilient for assisting in retaining the shell 12 in the ear canal 120 of the user so that the shell 12 remains securely in place in the ear canal 120 without falling out of the ear. The ongoing development of smaller and smaller hearing aid components makes it possible to provide smaller and smaller custom made shells making retention of the device in the proper place more difficult since the ear canal is a dynamic environment. During chewing, smiling, yawning, and head movements, the cartilage in the ear canal is expanding and compressing. In general, the ear canal widens when the mouth opens and narrows when the mouth is closed. The magnitude of the variations of the ear canal is different for different individuals. Thus, jaw movements, e.g. chewing, yawning, smiling, etc, can exert outward forces on the shell 12 of the hearing aid 10. The resilient elongated member 14 counteracts such forces thereby securing the shell 12 from outward motion. The flexible elongated member 14 rests against an anatomical feature of the pinna 100 and due to its resilience exerts a force onto the shell 12 urging the shell 12 inwardly into the ear canal of the user and pressing the shell 12 against an anatomical feature within the ear canal thereby inhibiting outward movement of the shell 12.

Preferably, the flexible elongated member 14 is resilient in a direction perpendicular to its longitudinal extension for provision of the retention capability of the shell 12 in the ear canal 120 of the user. During positioning of the shell 12 in its intended position in the ear canal 120 of the user, the transverse resilience of the flexible elongated member 14 also facilitates insertion of the shell 12 into the ear canal 120 of the user.

In the illustrated embodiment of FIG. 2, when the hearing aid shell 12 is properly inserted into the ear canal of the user, the outward pointing end of the hearing aid shell 12 is aligned with, or approximately aligned with, the cavum conchae 190. In the illustrated embodiment, a battery door 26 is provided at the outward pointing end of the shell 12, and the battery door 26 coincides with, or approximately coincides with, the delimitation between the cavum conchae 190 and the ear canal.

Further, the flexible elongated member 14 is preferably configured to be positioned in the pinna 100 extending proximate the circumference of the cavum conchae 190 and abutting the antihelix 130 while at least partly being covered by the antihelix 130 for retainment of its position and making it at least partly invisible to other persons so that presence of the flexible elongated member 14 causes little detrimental effect on the natural appearance of the external ear.

Further, the flexible elongated member 14 may be configured to extend to the inferior crus 150 of the antihelix 130 so that the second end 18 is positioned at the cimba concha 160 of the ear below the triangular fossa when the hearing aid 10 is positioned in the ear of the user.

The flexible elongated member 14 may further be configured to abut part of the cavum concha 190 at the antitragus 180 when the shell 12 has been inserted in the ear canal 120, the resilient elongated member 14 thereby applying an upward force to the shell 12 towards the ear canal 120 retaining the shell 12 in a position in which the shell 12 is pressed against an anatomical feature in an upper part of the ear canal 120.

The ear canal 120 resides immediately above the temporomandibular joint, i.e. the jaw-joint, and thus, it is mainly the lower part of the ear canal 120 that is affected when the user makes jaw-movements, such as chewing, yawning, smiling, etc, while the upper part of the ear canal 120 remains relatively unaffected by such movements. It is therefore desirable to fit the shell 12 more tightly to the upper part of the ear canal 120 and less tightly to the lower part of the ear canal 120 in order to secure the shell 12 in the ear canal 120 of the user.

The flexible elongated member 14 may be preformed during manufacture, preferably into an arched shape with a curvature slightly larger than the curvature of the antihelix 130, for easy fitting of the flexible elongated member 14 into its intended position in the pinna 100. In some embodiments, the elongated member 14 has a relaxed configuration when the elongated member is not used, and has a bent configuration when it is placed in the ear. The relaxed configuration of the elongated member 14 may have a dimension that is larger than that of the bent configuration. For example, the relaxed configuration of the elongated member 14 may have a curvature that is less than the curvature of the bent configuration of the elongated member 14. Such configuration allows the elongated member 14 to exert a force against part(s) of the ear to thereby stabilize the shell 12 relative to the ear.

The flexible elongated member 14 may be heat formable so that the member 14 may be formed during fitting of the hearing aid 10 to a specific user, e.g. using a hot air gun for heating of the elongated member 14 and while heated forming the member 14 into an arcuate shape corresponding to the outer ear of the user, for example with an arcuate shape bending slightly less than the antihelix 130 of the pinna 100 for retention of the flexible elongated member 14 behind the antihelix 130. Upon cooling, the flexible elongated member 14 retains its customized shape.

Provision of the flexible and resilient elongated member 14 provides improved retention of the customized shell 12 in a straight ear canal 120 in which it may be difficult to obtain a secure grip and attachment of the customized shell 12 to the ear canal 120 without the elongated member 14.

Provision of the flexible and resilient elongated member 14 makes it possible to make the fit between the ear canal 120 and the custom made shell 12 less tight (e.g., having some spacing therebetween) thereby increasing user comfort during use of the hearing aid 10.

In some embodiments, the flexible elongated member 14 has a lumen that accommodates the microphone, preferably at its second end 18, with signal conductors extending within the flexible elongated member 14 for electrical interconnection of the microphone with other components in the hearing aid shell 12. In some cases, the lumen of the flexible elongated member 14 also houses one or more wires that connect to the microphone, with at least one wire for providing a current to the microphone. In other embodiments, the elongated member 14 houses only the wire(s), and not the microphone. In such cases, the microphone may be secured to the free end of the flexible elongated member 14.

For example, in the illustrated embodiment, the microphone of the hearing aid 10 is positioned at the microphone input port 20 at the second end 18 of the flexible elongated member 14. Placing the microphone outside the shell 12 has the benefit of allowing the shell 12 to be made smaller because it does not need to house as many components. Alternatively, the size of the shell 12 may remain unchanged, and the configuration of the microphone allows a larger size receiver that is more powerful to be placed inside the shell 12. Placing the microphone at/near the end of the member 14 is also advantageous in that the flexible elongated member 14 may be used to remove the device, while keeping the user's fingers away from microphone. This may reduce the transmission of natural body oils to the microphone that can reduce the reliability of the microphone. Furthermore, the configuration of the microphone may allow optimization of vent location whereby the vent may be placed in a location to maximize the distance between the vent and the microphone, thereby reducing the risk of external feedback.

A custom made shell 12 is individually custom manufactured to fit precisely in the ear canal 120 of a specific user so that the shell 12 can be retained securely in its intended position in the ear canal 120 without causing discomfort to the user. Typically, the individual fit to the ear canal 120 in question is obtained by an impression taking technique by which an impression material, typically a silicone material, is injected into the ear canal 120. An otoblock is inserted past the second bend of the ear canal 120 for prevention of the impression material from reaching the eardrum. The shape of the ear canal 120 is then captured by the impression. Upon solidification, the impression is removed and a cast is made from the impression, and finally the custom made shell 12 is cast. It should be noted that the term "custom made shell" should not be limited to the above described manufacturing process, and that the term "custom made shell" may refer to any shell made from any technique as long as the shell has a shape, dimension, size, rigidity, and/or other feature that is specific for a user.

As discussed, the customized shell 12 of this embodiment may be made smaller due to removal of the microphone from the shell 12, or a larger receiver may be accommodated in the shell 12 for provision of a hearing aid 10 with a high output power. The fit of the customized shell 12 to the ear canal 120 makes it possible to provide a high sound pressure to the ear drum of the user since the fit is sufficiently tight to maintain a high pressure in the volume of the ear canal 120, between the wall of the shell 12 and the ear drum.

Further, the large distance between the microphone and the receiver in this embodiment decreases the risk of external feedback, i.e. transmission of sound between the receiver and the microphone of the hearing aid 10 along a path outside the customized shell 12. Sound from the receiver that might leak through a possible narrow passage (that is between the wall of the customized shell 12 and the wall of the ear canal) and/or through a possible vent must travel a large distance to reach the microphone, and is therefore sufficiently attenuated for feedback not to occur or to occur on rare occasions only.

As further described below, electronic feedback suppression may also be provided in the hearing aid 10 according to some embodiments.

Further, for this embodiment, the receiver need not be flexibly mounted in the customized shell 12 in order to avoid internal feedback by transmission of mechanical vibrations from the receiver to other parts of the hearing aid 10, since the elongated member 14 provides attenuation of such mechanical vibrations propagating from the customized shell 12 to the microphone. Hereby, the volume occupied by the receiver and the receiver mounting is minimized so that the customized shell 12 may be further minimized, or an even larger receiver may be accommodated in the shell 12 for provision of a hearing aid 10 with an increased output power. Still further, the production process of the embodiment is significantly simplified due to simplification of the procedure to mount the receiver.

Thus, due to attenuation provided by the elongated member 14 of mechanical vibrations, it is possible to mount the receiver in close contact with the customized shell 12, i.e. suspension of the receiver in resilient suspensions within the customized shell 12 is not necessary. The receiver may be snugly fitted within the customized shell 12, e.g. within a compartment of the customized shell 12 having mechanical support elements abutting the shell 12 when mounted and keeping the receiver in a specific position during use. Such configuration allows the receiver to be more easily secured relative to the shell 12, and also allows the shell 12 to be made smaller (e.g., the shell 12 can be sized and shaped to snugly house the receiver without having large spaces therebetween to suspend the receiver). Alternatively, the dimension of the shell 12 may maintain unchanged, and the above configuration allows a larger size receiver that is more powerful to be placed in the shell 12. In either case, feedback will be suppressed by accommodation of the microphone in the elongated member 14.

Provision of a smaller shell 12 makes it easier to provide a comfortable fit in a narrow ear canal 120. Further, a short shell 12 will be easier to fit to an ear canal 120 with a sharp bend. Further, a short shell 12 may not get in contact with the bony part of the ear canal of a user during use, thereby providing additional comfort for the user.

The flexible elongated member 14 may have a larger cross-section at the second end 18 accommodating the microphone than a remaining part of the flexible elongated member 14 extending therefrom and towards the first end 16.

The flexible elongated member 14 may accommodate other electrical hearing aid components, for example a directional microphone, an array of microphones, a telecoil, push-buttons or dial for user control of the hearing aid 10, an inductive coil for wireless charging of a rechargeable hearing aid battery, an antenna for wireless communication and control, etc. Also, in further embodiments, the flexible elongated member 14 may house a temperature sensor for sensing temperature, a pressure sensor for sensing air pressure, a moisture sensor for sensing humidity, an acceleration sensor for sensing an acceleration, such as a G-force, or combination of any of the foregoing. In some embodiments, the shell 12 and/or the end of the flexible elongated member 14 may further include a display for displaying information regarding the sensed characteristic(s) by any or a combination of the above-described sensors. In other embodiments, the sensor(s) may be coupled to the flexible elongated member 14 in other manners, such as on a surface of the member 14, or at the free end of the member 14.

In any of the embodiments described herein, two microphones may be accommodated at the second end 18 of the flexible elongated member 14 for provision of noise suppression and/or further directionality.

Preferably, the illustrated flexible elongated member 14 is substantially rigid in the direction of its longitudinal extension so that electrical conductors residing in the flexible elongated member 14 are protected against breaking.

With a microphone in the flexible elongated member 14 at its second end 18, it has been found that localisation is substantially maintained when the microphone is positioned at a location within the pinna 100 wherein the microphone receives a sound signal that allows the user to perceive the direction towards a sound source. In this case, the sound signal based on which the user is capable of perceiving direction is transmitted to the ear drum of the user by the hearing aid 10. For example, sense of direction may be substantially maintained when the microphone is positioned at the cimba concha 160 below the triangular fossa in the pinna 100.

Thus, with a microphone in the flexible elongated member 14 at its second end 18 that is positioned at the cimba concha 160 of the ear below the triangular fossa, localisation is substantially maintained since the microphone is positioned at a location within the pinna 100 wherein the received sound signal enables the user to perceive direction towards a sound source from the signal transmitted to the ear drum of the user by the hearing aid 10.

The flexible elongated member 14 and the shell 12 may form separate units that are manufactured in separate pieces that are interconnected mechanically and electrically during manufacture of the hearing aid 10 or during fitting to a particular user.

The flexible elongated member 14 may be manufactured in a number of standard sizes, e.g. standard lengths, to fit the human anatomy of the pinna 100 of most users. In this way, the manufacturing cost is lowered as compared to the manufacturing cost of customized flexible elongated members 14. In other embodiments, a flexible member which is sufficiently long for most/all users may be provided. In such cases, the flexible member may then be shortened to achieve a desired length for the flexible elongated member 14 during fitting in dependence of the actual user. For example, the long flexible member may include a plurality of weak points along its length, which allow a user to manually break off portion of the long flexible member to obtain the flexible elongated member 14 with a desired length. In other embodiments, the length of the flexible elongated member 14 may be adjusted using other techniques. For example, in the third embodiment of FIG. 4, the length of the flexible elongated member 14 may be adjusted by sliding the end of the member 14 relative to the opening. When a desired length of the member 14 has been achieved, the adhesive may then be applied to secure the member 14. In the fourth embodiment of FIG. 4, the length of the flexible elongated member 14 may be adjusted by screwing the member 14 clockwise or counter-clockwise relative to the screw-hole. In should be noted that the adaptable-length feature may be employed for any of the embodiments described herein. Embodiments of FIG. 4 will be discussed in further details below.

The flexible elongated member 14 may be removably interconnected with the shell 12 for easy fitting of a customized shell 12 with a specific standard/customized sized flexible elongated member 14, or, for easy substitution of the current flexible elongated member 14 with a new one and/or for easy substitution of components accommodated by the flexible elongated member 14, e.g. the microphone.

Alternatively, the shell 12 and the flexible elongated member 14 form an integral member 14 that is manufactured in one piece.

Figure 11A:
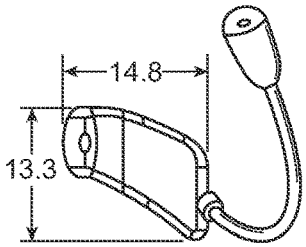
Figure 11B:
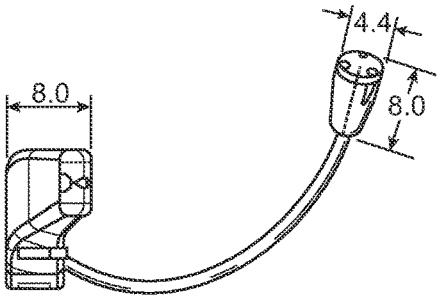
Figure 11C:
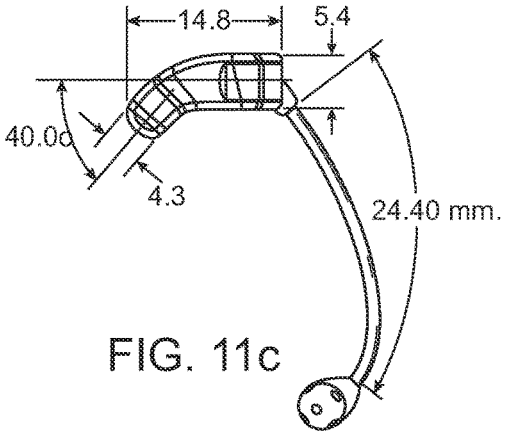
Figure 11D:
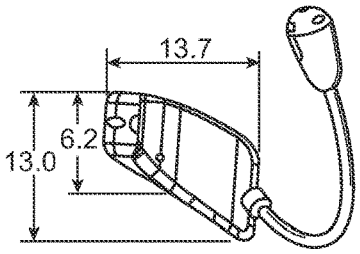
Figure 11E:
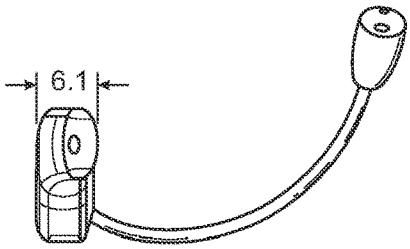
Figure 11F:
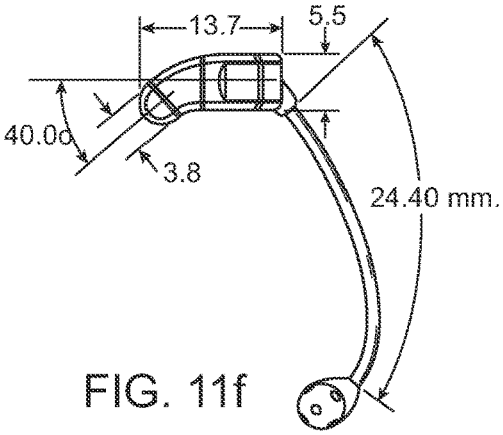

FIGS. 11*a*-11*f* illustrate a hearing aid having exemplary dimensions in accordance with some embodiments. FIG. 11*a* shows a first view, FIG. 11 *b* shows a second view, FIG. 11*c* shows a third view, FIG. 11*d* shows a fourth view, FIG. 11*e* shows a fifth view, and FIG. 11*f* shows a sixth view, of the hearing aid in accordance with some embodiments. The hearing aid illustrated may be any of the embodiments described herein. It should be noted that any components of the hearing aid may be customized in some embodiments, and thus, the dimensions in FIGS. 11*a*-11*f* may vary from user to user. Alternatively, the dimensions in FIGS. 11*a*-11*f* may be those for a standard size, or one of the standard sizes that are made available to users.

FIGS. 3*a*-3*d* show various embodiments wherein the custom made shell 12 is provided with a faceplate 24 and a battery door 26 in the faceplate 24 providing access to a battery compartment. The delimitation between the faceplate 24 and the remaining part of the shell 12 is indicated at 28. Various possible positions of the interconnection between the flexible elongated member 14 and the custom made shell 12 are shown. In particular, the first embodiment of FIG. 3*a* shows the flexible elongated member 14 connecting to an end surface of the faceplate 24. The second embodiment in FIG. 3*b* shows the flexible elongated member 14 secured between the faceplate 24 and the shell 12. The third embodiment in FIG. 3*c* shows the flexible elongated member 14 connecting to the shell 12. The forth embodiment in FIG. 3*d* shows the shell 12 having an end portion, wherein the flexible elongated member 14 is connected to the end portion of the shell 12.

FIGS. 4*a*-4*d* show various types of possible mechanical interconnections between the flexible elongated member 14 and the custom made shell 12/faceplate 24. The first embodiment of FIG. 4*a* shows the end of the elongated member 14 having a first protrusion 400 and a second protrusion 402 that are for abutting against respective opposite surfaces of the shell 12/faceplate 24. The second embodiment of FIG. 4*b* shows the end of the elongated member 14 having a sphere 410 that is for mating with a socket 412 defined by the shell 12/faceplate 24, thereby forming a ball-joint. The third embodiment in FIG. 4*c* shows the end of the elongated member 14 being secured to the shell 12/faceplate 24 using an adhesive 420. The fourth embodiment in FIG. 4*d* shows the end of the elongated member 14 having screw threads 430 for allowing the elongated member 14 to be screwed into screw-hole 432 defined by the shell 12/faceplate 24. It should be noted that the manner in which the elongated member 14 is secured to the shell 12/faceplate 24 should not be limited to the examples illustrated, and that other mechanisms known in the art may also be used to secure the elongated member 14 relative to the shell 12/faceplate 24.

With reference to FIG. 5, the flexible elongated member 14 may be attached to the battery door 26 and the battery door 26 may be removably attached to the shell 12 with a connector for removal of the flexible elongated member 14 from the shell 12 together with the battery door 26.

The connector may further be configured for making electrical contact with a signal line in the flexible elongated member 14 when the battery door 26 is attached to the shell 12.

FIG. 6*a* illustrates a shell 12 and FIG. 6*b* illustrates a battery door 26 for the shell 12 in accordance with some embodiments. The battery door 26 is provided at an end of the shell 12 facing out of the ear canal 120 when the hearing aid 10 is positioned in the ear. The battery door 26 has a compartment 30 accommodating the battery (not shown). The battery compartment 30 swings out of the shell 12 when the battery door 26 is opened whereby the battery may be exchanged with a new battery. The flexible elongated member 14 is attached to the battery door 26, and the battery door 26 is removably attached to the shell 12 with a connector 64 comprising resilient electrical contact members 66 for electrical interconnection of signal conductors in the flexible elongated member 14 with electrical components in the shell 12. In some cases, the battery door 26 itself can be considered a connector or a part of a connector. In other embodiments, the terminals 36 may advantageously be placed on the opposite side compared to the embodiments shown in FIG. 6; i.e. further away from the hinge.

The user may open or close the battery door 26 by rotating the battery door 26 around an axis of rotation provided by a hinge connection. The battery compartment 30 swings out of the shell 12 when the battery door 26 is opened whereby the battery may be exchanged with a new battery.

In the illustrated embodiment, the hinge connection has a shaft 74, and the battery door 26 has a resilient recess 42 so that a person may attach the battery door 26 to the hearing aid shell 12 by pressing the recess 42 around the shaft 74 whereby the recess 42 expands slightly to accommodate the shaft 74 and snaps back for retention of the shaft within the recess. Likewise, the user may remove the battery door 26 from the hearing aid shell 12 by pulling the battery door 26 away from the hearing aid shell 12 whereby the recess expands to release the shaft and snaps back into its original relaxed shape upon release of the shaft 74. The illustrated snap fit coupling for interconnection of the battery door 26 with the hearing aid shell 12 is designed so that the force required to separate the battery door 26 from the hearing aid shell 12 is larger than the force required to pull the hearing aid shell 12 out of the ear canal 120 of the user by pulling the flexible elongated member 14.

The illustrated hearing aid shell connector 32 further comprises resilient electrical contact members 36 for electrical interconnection of signal conductors in the flexible elongated member 14 with electrical components in the shell 12.

The electrical contact members 36 of the interconnected battery door 26 slidably connects with respective electrical contact members 66 of the shell 12 when the battery compartment 30 is closed by rotation. The sliding connection provides a cleaning action thereby cleaning the contact surfaces maintaining a low contact resistance across the electrical interconnection of the hearing aid components, e.g. by mechanical removal of oxide film formed on the contact surfaces, or mechanical removal of other undesired deposits on the contact surfaces.

In other embodiments, the flexible elongated member 14 is removably connected directly with the hearing aid shell 12, e.g. directly to the faceplate 24. In this embodiment (not shown), the flexible elongated member 14 has an electrical connector at its first end 16 mating a corresponding hearing aid shell connector. The connector is inserted through a hole provided in the hearing aid shell 12. The battery door 26 may be provided with a suitable mechanical member that assists in attaching the flexible elongated member 14 to the hearing aid shell 12 by abutment with the flexible elongated member 14 when the battery door 26 is closed. The battery door 26 may include locking means preventing the battery door 26 from being inadvertently opened e.g. due to forces applied to the flexible elongated member 14.

FIGS. 7*a*-7*c* illustrate positioning of a microphone 902*a* at the second end 18 of a flexible elongated member 14 in accordance with some embodiments. As shown in FIG. 7*a*, the microphone 902*a* and its signal conductors 17 are inserted into the flexible elongated member 14 through an open second end 18 of the flexible elongated member 14, and the microphone 902*a* is pushed into its desired position shown in FIG. 7*b*. The signal conductors 17 with the signal line of the microphone 902*a* extend inside the flexible elongated member 14. Finally, a threaded cap 19 with the cerumen filter closes the opening of the flexible elongated member 14 as illustrated in FIG. 7*c*.

FIG. 8 illustrates the interconnection of the signal conductors 17 with the contact members 36 in accordance with some embodiments. In the illustrated embodiments, the contact members 36 are provided on a slide member that may slide into a mating compartment in the battery door 26 for positioning of the contact members 36 as for example illustrated in FIG. 6. Upon insertion of the microphone 902*a* and the signal conductors 17 into the flexible elongated member 14, the exposed ends of the signal conductors 17 or soldered onto the contact members 36 provided on the slide member. Subsequently, the slide member is inserted into the battery door 26 and possibly glued to the battery door 26.

FIG. 9 shows a simplified block diagram of a digital hearing aid 10 according to some embodiments. The hearing aid 10 comprises one or more sound input transducers, e.g. two microphones 902*a* and a telecoil 902*b*. The analogue signals for the microphones are coupled to an analogue-digital converter circuit 903, which contains an analogue-digital converter 904 for each of the microphones.

The digital signal outputs from the analogue-digital converters 904 are coupled to a common data line 905, which leads the signals to a digital signal processor (DSP) 906. The DSP is programmed to perform the necessary signal processing operations of digital signals to compensate hearing loss in accordance with the needs of the user. The DSP is further programmed for automatic adjustment of signal processing parameters in accordance with some embodiments.

The output signal is then fed to a digital-analogue converter 912, from which analogue output signals are fed to a sound transducer 913, such as a miniature loudspeaker.

In addition, externally in relation to the DSP 906, the hearing aid 10 contains a storage unit 914, which in the example shown is an EEPROM (electronically erasable programmable read-only memory). This external memory 914, which is connected to a common serial data bus 905, can be provided via an interface 915 with programmes, data, parameters etc. entered from a PC 916, for example, when a new hearing aid 10 is allotted to a specific user, where the hearing aid 10 is adjusted for precisely this user, or when a user has his hearing aid 10 updated and/or re-adjusted to the user's actual hearing loss, e.g. by an audiologist.

The DSP 6 contains a central processor (CPU) 907 and a number of internal storage units 908-911, these storage units containing data and programmes, which are presently being executed in the DSP circuit 906. The DSP 906 contains a programme-ROM (read-only memory) 908, a data-ROM 909, a programme-RAM (random access memory) 910 and a data-RAM 911. The two first-mentioned contain programmes and data which constitute permanent elements in the circuit, while the two last-mentioned contain programmes and data which can be changed or overwritten.

Typically, the external EEPROM 914 is considerably larger, e.g. 4-8 times larger, than the internal RAM, which means that certain data and programmes can be stored in the EEPROM so that they can be read into the internal RAMs for execution as required. Later, these special data and programmes may be overwritten by the normal operational data and working programmes. The external EEPROM can thus contain a series of programmes, which are used only in special cases, such as e.g. start-up programmes.

In some embodiments, the hearing aid 10 further comprises a feedback compensation circuit for providing a feedback compensation signal of signals picked up by the microphone by modelling an acoustical and mechanical feedback signal path of the hearing aid 10, subtracting means for subtracting the feedback compensation signals from the audio signal to form a compensated audio signal, which is input to the signal processor of the hearing aid 10.

Preferably, the feedback compensation means comprises an adaptive filter, i.e. a filter that changes its impulse response in accordance with changes in the feedback path.

Both static and adaptive filters are well known to a person skilled in the art of hearing aids, and will therefore not be discussed in further detail here.

A block diagram of an embodiment of a hearing aid 10 with a feedback compensation filter 106 is shown in FIG. 10. The hearing aid 10 comprises a microphone 101 for receiving incoming sound and converting it into an audio signal. A receiver 102 converts output from the hearing aid processor 103 into output sound, which in, e.g., a hearing aid 10 is supposed to be modified to compensate for a users hearing impairment. Thus, the hearing aid processor 103 comprises elements such as amplifiers, compressors and noise reduction systems etc.

A feedback path 104 is shown as a dashed line between the receiver 102 and the microphone 101. Due to the feedback path, the microphone 101 may pick up sound from the receiver 102 which may lead to well known feedback problems, such as whistling.

The (frequency dependent) gain response (or transfer function) H(.omega.) of the hearing aid 10 (without feedback compensation) is given by:

$$H(\omega) = \frac{A(\omega)}{1 - F(\omega)A(\omega)} \tag{1}$$

where w represents (angular) frequency, F(w) is the gain function of the feedback path 104 and A(w) is the gain function provided by the hearing aid processor 103. The feedback compensation filter 106 is configured to feed a compensation signal to the subtraction unit 105, whereby the compensation signal is subtracted from the audio signal provided by the microphone 101 prior to processing in the hearing aid processor 103. The transfer function now becomes:

$$H(\omega) = \frac{A(\omega)}{1 - (F(\omega) - F'(\omega))A(\omega)} \tag{2}$$

where F'(w) is the gain function of the compensation filter 106. Thus, F'(w) estimates the true gain function F(w) of the feedback path, the closer H(w) will be to the desired gain function A(w).

As previously explained, the feedback path 104 is usually a combination of internal and external feedback paths and acoustical and mechanical feedback paths.

Although particular embodiments have been shown and described, it will be understood that it is not intended to limit the present inventions, and it will be obvious to those skilled in the art that various changes and modifications may be made without departing from the spirit and scope of the present inventions. For example, in other embodiments, the hearing aid 10 may have a different system architecture as that shown in FIG. 9. Further, in other embodiments, instead of having a customized configuration, the shell of the hearing aid may have a standard size, shape, etc. Also, an illustrated embodiment needs not have all the aspects or advantages shown. An aspect or an advantage described in conjunction with a particular embodiment is not necessarily limited to that embodiment, and can be practiced in any other embodiments even if not so illustrated. The specification and drawings are, accordingly, to be regarded in an illustrative rather than restrictive sense. The scope of the present invention is set out by the accompanying claim set. In the context of the claims, the terms "comprising" or "comprises" do not exclude other possible elements or steps. Also, the mentioning of references, such as "a", "an", etc., should not be construed as excluding a plurality.

The invention claimed is:

1. A hearing aid comprising:

a shell for accommodation of a signal processor for processing an audio signal into a processed audio signal, a receiver that is connected to an output of the signal processor for converting the processed audio signal into an acoustic sound signal, and a rechargeable battery, wherein the signal processor is programmable to compensate for a hearing loss; and a flexible elongated member with a first end coupled to the shell, and a second end, the second end of the flexible elongated member being a free end, wherein the flexible elongated member has a shape such that when the flexible elongated member is placed in an ear of a user, the second end is positioned inside a pinna and outside an ear canal of the user;

wherein the flexible elongated member is configured to push the shell towards the canal of the ear.

2. The hearing aid according to claim 1, wherein the first end of the flexible elongated member is coupled to the shell with an adhesive.

3. The hearing aid according to claim 1, wherein the first end of the flexible elongated member is coupled to the shell by a ball joint.

4. The hearing aid according to claim 1, wherein the flexible elongated member is removably coupled to the shell.

5. The hearing aid according to claim 4, wherein the flexible elongated member is removably coupled to the shell with a connector.

6. The hearing aid according to claim 1, wherein the shell comprises a faceplate and wherein the first end of the flexible elongated member is coupled to the faceplate.

7. The hearing aid according to claim 6, wherein the shell comprises a portion covering the rechargeable battery, and wherein the first end of the flexible elongated member is coupled to the portion of the shell.

8. The hearing aid according to claim 7, wherein the portion comprises a battery door.

9. The hearing aid according to claim 8, wherein the battery door is removably attached to the shell by a snap fit coupling.

10. The hearing aid according to claim 8, wherein the battery door is attached to the faceplate with a connector.

11. The hearing aid according to claim 1, wherein the flexible elongated member is configured to abut an antihelix.

12. The hearing aid according to claim 11, wherein the flexible elongated member is further configured to extend at least to an inferior crus of the antihelix during use.

13. The hearing aid according to claim 1, wherein the flexible elongated member is configured so that the second end is positioned below a triangular fossa of the pinna during use.

14. The hearing aid according to claim 1, wherein the flexible elongated member is configured to abut a part of a concha at an antitragus when the shell has been inserted in the ear canal thereby applying a force to the shell towards the ear canal retaining the shell in a position in which the shell is pressed against an anatomical feature within the ear canal.

15. The hearing aid according to claim 1, wherein the flexible elongated member is substantially rigid in its longitudinal direction.

16. The hearing aid according to claim 1, wherein the flexible elongated member is configured for accommodation of at least one hearing aid component selected from the group consisting of an omni-directional microphone, a directional microphone, an array of microphones, a telecoil, a push-button, a dial, an inductive coil, and an antenna.

17. The hearing aid according to claim 1, wherein the flexible elongated member is configured for accommodation of a microphone, and wherein a part of the flexible elongated member accommodating the microphone has a larger cross-section than a remaining part of the flexible elongated member extending therefrom and towards the first end.

18. The hearing aid according to claim 1, wherein the flexible elongated member comprises a lumen for housing a wire that provides current to an electronic device, the flexible elongated member having a shape for stabilizing the shell relative to the ear.

19. The hearing aid according to claim 1, wherein the shell has a dimension that is specific for the user.

20. The hearing aid according to claim 1, wherein the flexible elongated member is resilient in a direction perpendicular to a longitudinal extension of the elongated member.

21. The hearing aid according to claim 1, further comprising the signal processor and receiver.

22. The hearing aid according to claim 1, further comprising a sensor coupled to the flexible elongated member, wherein the sensor is selected from the group consisting of a temperature sensor, a moisture sensor, an acceleration sensor, and a pressure sensor.

23. The hearing aid according to claim 1, further comprising the rechargeable battery.

24. The hearing aid according to claim 1, wherein the shell comprises a custom made shell.

25. A hearing aid comprising:

a shell for accommodation of a signal processor for processing an audio signal into a processed audio signal, a receiver that is connected to an output of the signal processor for converting the processed audio signal into an acoustic sound signal, and a rechargeable battery;

a flexible elongated member with a first end attached to the shell, and a second end, the second end being a free end; and a microphone at the free end of the flexible elongated member;

wherein the flexible elongated member comprises a lumen for housing a wire that is coupled to the microphone, the flexible elongated member having a shape for stabilizing the shell relative to an ear of a user; and wherein the elongated member is configured to push the shell towards a canal of the ear.

26. The hearing aid according to claim 25, wherein the shell has a dimension that is specific for the user.

27. The hearing aid according to claim 25, wherein the elongated member is resilient in a direction perpendicular to a longitudinal extension of the elongated member.

28. The hearing aid according to claim 25, further comprising the signal processor and receiver.

29. The hearing aid according to claim 25, further comprising the rechargeable battery.

30. The hearing aid according to claim 25, wherein the shell comprises a portion covering the rechargeable battery.

31. The hearing aid according to claim 30, wherein the portion of the shell comprises a battery door.

32. The hearing aid according to claim 25, further comprising a sensor coupled to the flexible elongated member, wherein the sensor is selected from the group consisting of a temperature sensor, a moisture sensor, an acceleration sensor, and a pressure sensor.

33. The hearing aid according to claim 25, wherein the shell comprises a faceplate and wherein the first end of the flexible elongated member is coupled to the faceplate; and wherein a part of the flexible elongated member accommodating the microphone has a larger cross-section than a remaining part of the flexible elongated member extending therefrom and towards the first end.

34. The hearing aid according to claim 25, wherein the shell comprises a custom made shell.

* * * * *